US006585123B1

(12) United States Patent
Pedmo et al.

(10) Patent No.: US 6,585,123 B1
(45) Date of Patent: Jul. 1, 2003

(54) BOTTLE BASE

(75) Inventors: Marc A. Pedmo, Litchfield, OH (US); Richard C. Darr, Medina, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 10/154,677

(22) Filed: May 22, 2002

(51) Int. Cl.[7] ..... B65D 1/02; B65D 1/42; B65D 23/00

(52) U.S. Cl. ..... 215/10; 215/373; 215/365; 206/509; 220/608; 220/674

(58) Field of Search ..... 215/373, 365, 215/366, 367, 10; 40/310; 220/606, 674, 608, 23.6; 206/459.5, 509

(56) References Cited

U.S. PATENT DOCUMENTS 3,745,314 A * 7/1973 Mathias et al. ..... 235/61.11 E
4,024,975 A * 5/1977 Uhlig ..... 215/373
4,108,324 A * 8/1978 Krishnakumar et al. 215/373 X
4,134,510 A * 1/1979 Chang ..... 215/373
4,525,401 A * 6/1985 Pocock et al. ..... 215/373 X
4,620,639 A * 11/1986 Yoshino ..... 215/373
4,644,151 A * 2/1987 Juvinall ..... 250/223 R
6,065,624 A * 5/2000 Steinke ..... 215/373 X

FOREIGN PATENT DOCUMENTS

JP 6156466 * 6/1994 ..... 40/310

* cited by examiner

*Primary Examiner*—Sue A. Weaver
(74) *Attorney, Agent, or Firm*—Robert H. Bachman

(57) ABSTRACT

Biaxially oriented, hollow plastic bottle of thermoplastic material having an improved base. The base includes an outer supporting annular rim for supporting the bottle on a surface and an inwardly extending portion of the base, wherein the space between the central portion of the base and the outer supporting rim includes a plurality of struts extending radially from the central portion of the base towards the annular rim.

17 Claims, 3 Drawing Sheets

BOTTLE BASE

BACKGROUND OF THE INVENTION

The present invention relates to a hollow plastic bottle with an improved base.

Hollow plastic bottles generally include a recessed or inwardly extending or reentrant base structure. This type of base has been found to have good resistance to deformation, especially deformation caused by the effects of internal pressure.

However, it is desirable to provide a recessed base structure for hollow plastic bottles with improved strength properties. For example, increased strength properties in the recessed base will facilitate use of the container for increased heat applications, as pasteurization. Also, increased strength properties will improve impact strength, minimizing damage when the bottles are accidentally dropped. Further, improved strength properties in the base will help prevent roll-out, i.e., under pressure or heat the plastic bottles tend to roll-out or bulge at the base.

It is, therefore, a principal object of the present invention to provide a hollow plastic bottle with an improved base.

It is a further object of the present invention to provide an improved plastic bottle as aforesaid with improved strength properties in the base.

It is a still further object of the present invention to provide an improved plastic bottle as aforesaid which is easy to prepare and which is aesthetically pleasing.

Further objects and advantages of the present invention will appear hereinbelow.

SUMMARY OF THE INVENTION

It has now been found that the foregoing objects and advantages are readily obtained in accordance with the present invention.

The hollow plastic bottle of the present invention comprises: a hollow body of thermoplastic material having a generally cylindrical side wall, an upper end with a dispensing opening therein, and a lower supporting base with an inwardly extending portion thereof, wherein said base includes a continuous outer supporting annular rim for supporting the bottle on a surface and a central portion of the base. In addition, the space between the central portion of the base and the outer supporting rim includes a plurality of struts extending radially from the central portion of the base towards said annular rim.

The plastic bottle is desirably blow molded, desirably biaxially oriented, and polyethylene terephthalate is a preferred material.

Preferably, from 6–10 of the struts are provided, the struts extend over a substantial portion of the base and may extend substantially to the annular rim, and desirably the struts extend outwardly from the plane of the base.

The plastic bottle of the present invention has improved strength properties so that the container may be effectively utilized for increased heat applications, as for example, pasteurization, without adverse effects. In addition, the container of the present invention is less susceptible to roll-out or bulging at the base, and has improved impact properties.

Further features and advantages of the present invention will appear hereinbelow.

BRIEF DESCRIPTION OF THE DRAWINGS

The present invention will be more readily understandable from a consideration of the accompanying, illustrative drawings, wherein.

DETAILED DESCRIPTION OF PREFERRED EMBODIMENTS

Figure 2:
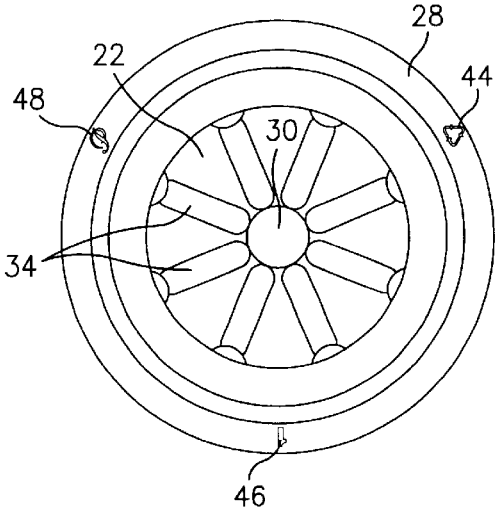
FIG. 2 is a bottom view of the base of the bottle of FIG. 1.
Figure 1:
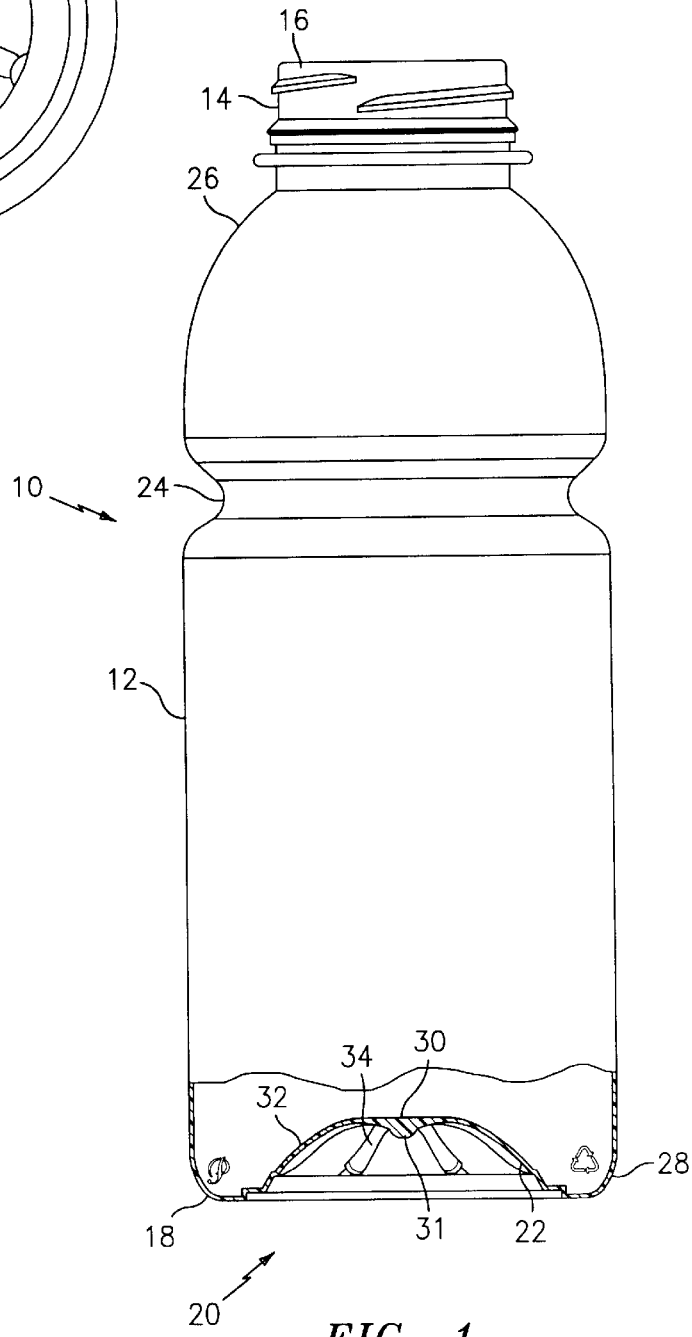
FIG. 1 is a side view of the bottle of the present invention with the base shown in section.
Figure 4:
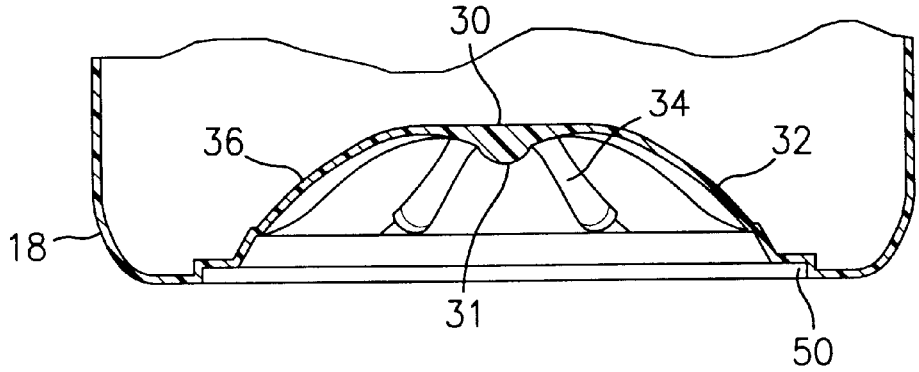
FIG. 4 is an enlarged sectional view of the base of the bottle of FIG. 1.
Figure 5:
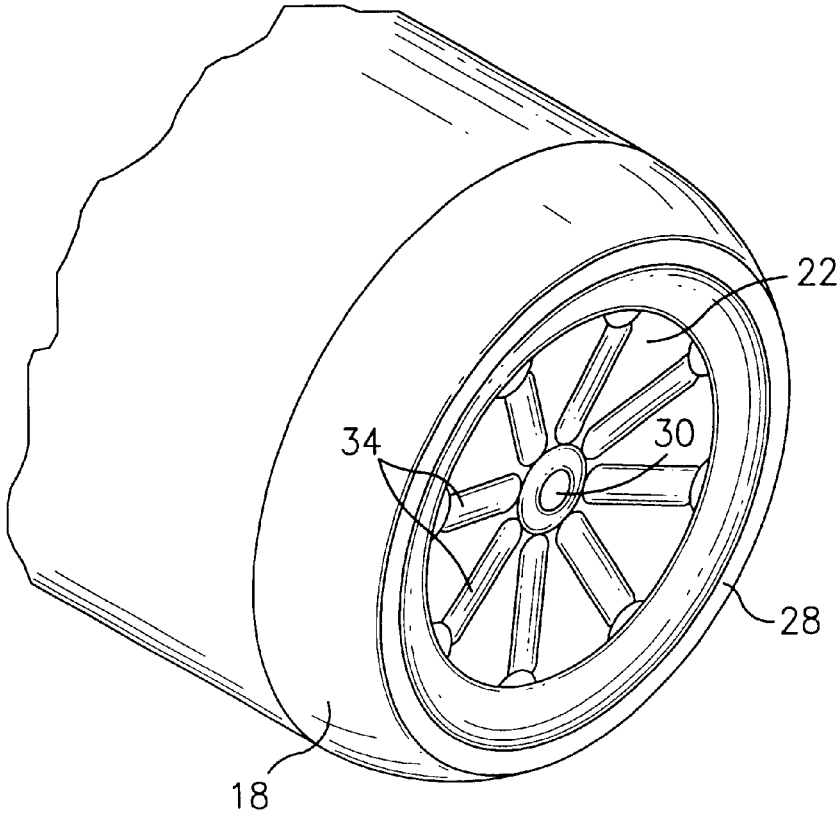
FIG. 5 is an enlarged, perspective view of the base of the bottle of FIG. 1.

Referring specifically to FIG. 1 which shows hollow plastic bottle 10 of the present invention, said bottle including a generally cylindrical side wall 12, an upper end 14 with a dispensing opening 16 therein which is desirably configured to hold a suitable closure (not shown) and may be threaded if desired, and a lower supporting base 18 which is shown in section in FIG. 1. The supporting base 18 includes an inwardly extending portion 20 having an outside surface 22 thereof shown in more detail in FIGS. 4 and 5 and which will be discussed in more detail hereinbelow.

The particular size, shape and configuration of the bottle is not especially critical and any suitable and desirable bottle configuration may be used. Thus, the configuration shown in the drawings herein represents a representative embodiment, but others may readily be used. For example, the bottle 10 of FIG. 1 includes a side wall portion 24 of reduced diameter with respect to the remainder of the side wall, but the side wall may if desired extend uniformly directly to the upper end with only a short, inwardly extending transition portion 26 as shown in FIG. 1 and as is common in for example two liter plastic bottles, or a long transition portion if desired. Naturally, other suitable configurations may readily be employed, as one or two liter bottles, 16 ounce bottles, 8 ounce bottles, etc.

The base 18 of bottle 10 includes a continuous, outer supporting annular rim 28 for supporting the bottle 10 on a surface. In addition, the lower supporting base 18 includes a central portion or hub 30 having a downwardly extending button-like portion 31. Base 18 also includes a continuous curved portion 32 extending upwardly from the annular rim 28 to the hub 30, as clearly shown in FIG. 4.

A plurality of struts 34 extend radially from the central portion of the base or hub 30 towards the annular rim 28. Generally 6–10 of the struts are provided, with eight being shown in the embodiment of FIGS. 1–5. The struts extend over a substantial portion of the base and may extend substantially to the annular rim, are uniformly spaced around the central portion of the base, and extend outwardly from the plane of the base, all as shown. For example, the struts desirably extend over 25 to 75 percent of the base. Also, the inside surface 36 of the inwardly extending portion 20 of base 18 desirably includes a substantially smooth inside surface opposed to outside surface 22, as clearly shown in FIG. 4.

The base construction of the present invention as shown in the drawings and described above has been found to be quite advantageous. Thus, this provides considerable increased strength in a critical location. For example, the bottle of the present invention may be effectively used for increased heat applications, is less susceptible to roll-out or bulging at the base, and generally has improved impact properties. Also, the construction is simply and easily prepared and results in an aesthetically pleasing configuration.

Figure 3:
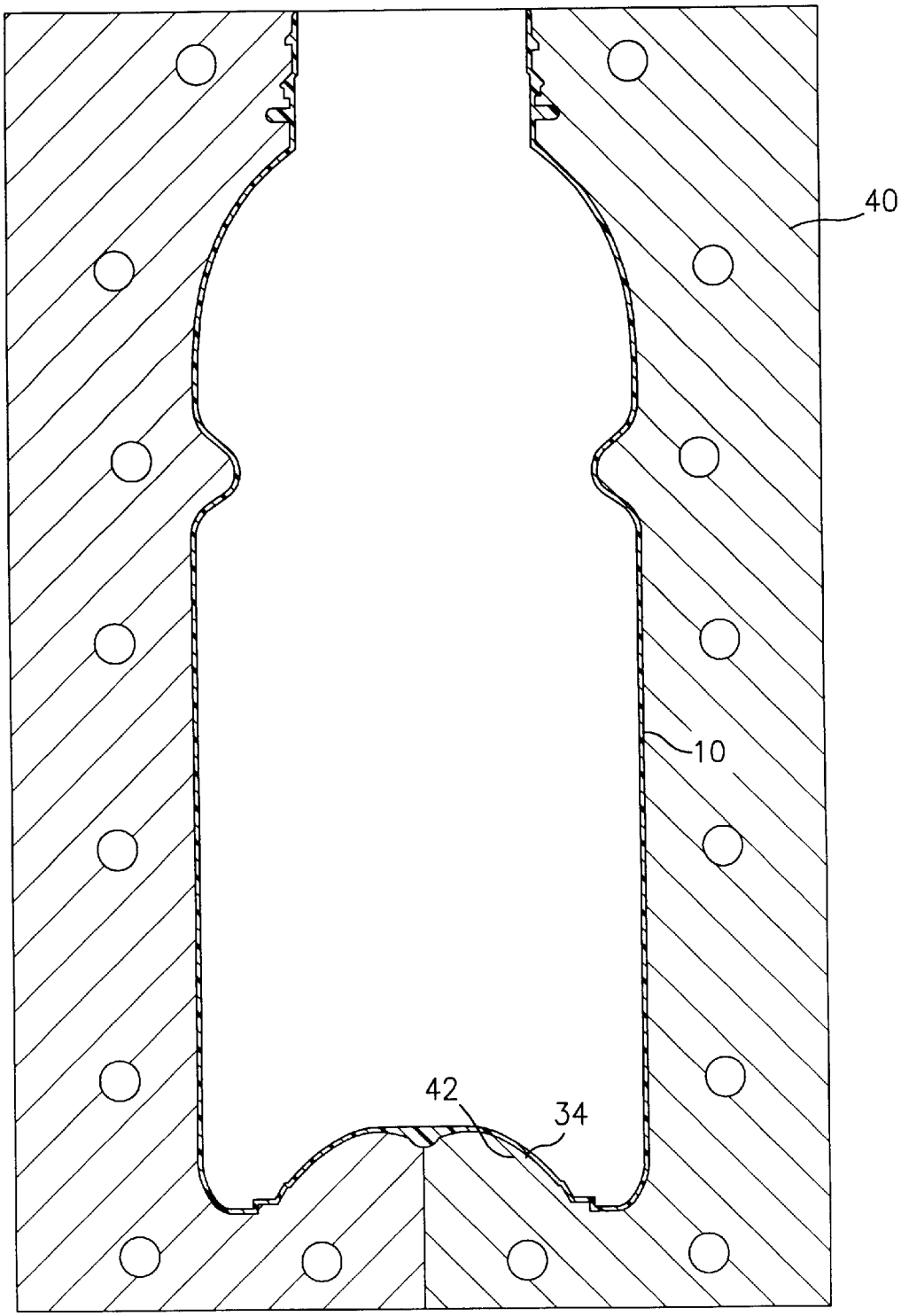
FIG. 3 is a sectional view of a blow mold with the final blow molded bottle of FIG. 1 therein.

The container or bottle of the present invention is desirably blow molded and biaxially oriented by injection stretch blow molding, as in a blow mold 40 as shown in FIG. 3 in a conventional manner from an injection molded or compression molded preform with the struts 34 formed from corresponding depressions 42 in the blow mold. However, the bottle may readily be prepared by simply injection molding.

Preferably, the plastic is polyethylene terephthalate; however, other suitable plastics may be readily used alone or in combination or in a multilayered configuration. For example, polyolefins, for example, high density polyethylene (HDPE), polyethylene naphthalate, polyvinyl chloride, and others.

Annular rim 28 of base 18 may desirably include information thereon, as for example the recycle symbol 44, a number 46 which can show mold number, lot number or any desired identification number, and one can include a corporate logo, designation or letter designation 48. Desirably, the information is space substantially uniformly around the periphery of the annular rim, and generally at least three sites for same are provided.

In addition, desirably the base 18 includes a peripheral stepped area 50 to facilitate stacking.

The present invention is particularly applicable to heat set containers, but is not limited thereto.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hollow plastic bottle, which comprises:

a hollow body of thermoplastic material having a generally cylindrical side wall, an upper end with a dispensing opening therein, and a lower supporting base with an inwardly extending portion having an outside surface thereof;

wherein said base includes a continuous outer supporting annular rim for supporting the bottle on a surface;

a central portion of said base; and wherein the space between the central portion of the base and the outer supporting rim includes a plurality of struts extending radially from the central portion of the base towards the annular rim, and wherein said base includes a peripheral stepped area to facilitate stacking located between the annular rim and struts.

2. A hollow plastic bottle according to claim 1, which is blow molded.

3. A hollow plastic bottle according to claim 1, which is biaxially oriented.

4. A hollow plastic bottle according to claim 1, wherein said bottle is polyethylene terephthalate.

5. A hollow plastic bottle according to claim 1, wherein said bottle is a polyolefin.

6. A hollow plastic bottle according to claim 1, including from 6 to 10 of said struts.

7. A hollow plastic bottle according to claim 1, wherein said struts extend over a substantial portion of the base.

8. A hollow plastic bottle according to claim 1, wherein said struts extend outwardly from the plane of the base.

9. A hollow plastic bottle according to claim 1, wherein said inwardly extending portion of the base includes a substantially smooth inside surface opposed to said outside surface.

10. A hollow plastic bottle according to claim 9, wherein the central portion of the base includes a downwardly extending outside portion and a flat inside surface opposed to said downwardly extending outside portion.

11. A hollow plastic bottle according to claim 1, including a continuous curved portion extending upwardly from the annular rim to the central portion of the base.

12. A hollow plastic bottle according to claim 1, wherein said bottle includes a neck portion of reduced diameter between the upper end and side wall.

13. A hollow plastic bottle according to claim 1, wherein said annular rim includes information thereon.

14. A hollow plastic bottle according to claim 13, wherein at least three sites for said information are provided substantially uniformly spaced around said annular rim.

15. A hollow plastic bottle according to claim 14, including three of said sites which separately include one of symbols, at least one number, and at least one letter embossed thereon.

16. A hollow plastic bottle according to claim 1, wherein said struts are uniformly spaced around the central portion of the base.

17. A hollow plastic bottle according to claim 1, wherein said struts extend outwardly from the central portion of the base on the inwardly extending portion of the base.

* * * * *